US011415941B2

(12) United States Patent
Fraessdorf

(10) Patent No.: US 11,415,941 B2
(45) Date of Patent: Aug. 16, 2022

(54) OSCILLATING SYSTEM FOR A WATCH

(71) Applicant: NOVASORT SA, La Chaux-de-Fonds (CH)

(72) Inventor: Karsten Fraessdorf, La Chaux-de-Fonds (CH)

(73) Assignee: WCP (WATCH CONNAISSEUR PROJECT) SA, La Chaux-de-Fonds (CH)

( * ) Notice: Subject to any disclaimer, the term of this patent is extended or adjusted under 35 U.S.C. 154(b) by 847 days.

(21) Appl. No.: 16/061,561

(22) PCT Filed: Dec. 14, 2016

(86) PCT No.: PCT/EP2016/081005
§ 371 (c)(1),
(2) Date: Jun. 12, 2018

(87) PCT Pub. No.: WO2017/102845
PCT Pub. Date: Jun. 22, 2017

(65) Prior Publication Data

US 2018/0364645 A1 Dec. 20, 2018

(30) Foreign Application Priority Data

Dec. 14, 2015 (EP) ..... 15199927

(51) Int. Cl.
*G04B 17/06* (2006.01)
*G04B 17/22* (2006.01)
(Continued)

(52) U.S. Cl.
CPC ..... *G04B 17/063* (2013.01); *G04B 17/222* (2013.01); *G04B 17/34* (2013.01); *G04B 29/02* (2013.01)

(58) Field of Classification Search
CPC .... G04B 17/063; G04B 17/222; G04B 17/06; G04B 29/02; G04B 17/34
See application file for complete search history.

(56) References Cited

U.S. PATENT DOCUMENTS 2,116,257 A 5/1938 Aegler
2,962,900 A * 12/1960 Reinhardt ..... G04B 17/063 74/1.5

(Continued)

FOREIGN PATENT DOCUMENTS

CH 22362 A 1/1902
CH 390808 A 12/1964

(Continued)

OTHER PUBLICATIONS

European Search Report from European Patent App. No. 19152279 (dated May 7, 2019).

(Continued)

*Primary Examiner* — Sean Kayes
(74) *Attorney, Agent, or Firm* — Kenealy Vaidya LLP

(57) ABSTRACT

Some embodiments are directed to adjusting the oscillation frequency of an oscillating system for a watch movement, including:

selecting a hairspring, selecting a balance belonging to a predetermined class, without a balance rim, at least two weight elements for balancing in a predetermined batch, pairing the hairspring with the balance and the at least two weight elements, measuring an oscillation frequency of the oscillating system including the hairspring, the balance and the at least two weight elements, and selecting at least one of a balance of another class or of the at least two weight elements of another batch if the (Continued)

measured oscillation frequency does not correspond to a desired oscillation frequency.

7 Claims, 8 Drawing Sheets

(51) Int. Cl.
*G04B 29/02* (2006.01)
*G04B 17/34* (2006.01)

(56) References Cited

U.S. PATENT DOCUMENTS

| | | | | |
|---|---|---|---|---|
| 3,382,667 | A * | 5/1968 | Horn | G04B 18/006 368/171 |
| 3,568,431 | A * | 3/1971 | Schaad | G04C 3/06 368/169 |
| 3,626,691 | A | 12/1971 | Bonsack | |
| 9,459,589 | B2 * | 10/2016 | Buhler | G04D 3/0041 |
| 2010/0157743 | A1 * | 6/2010 | Silva | G04D 7/10 368/127 |
| 2015/0309478 | A1 * | 10/2015 | Decoux | G04D 7/1214 73/648 |

FOREIGN PATENT DOCUMENTS

| | | | |
|---|---|---|---|
| CH | 1283368 | A | 12/1972 |
| DE | 528962 | C | 7/1931 |
| DE | 2113427 | A1 | 11/1971 |
| EP | 1256854 | A2 | 11/2002 |
| EP | 2063325 | A2 | 5/2009 |
| EP | 2455825 | A1 | 5/2012 |
| EP | 2570868 | A1 | 3/2013 |
| EP | 2874019 | A1 | 5/2015 |
| GB | 2416408 | A | 1/2006 |
| WO | WO2008/135817 | A2 | 11/2008 |

OTHER PUBLICATIONS

International Search Report and Written Opinion for PCT Patent App. No. PCT/EP2016/081005 (dated Mar. 22, 2017) with English translation of the ISR.

European Search Report and Written Opinion from European Patent App. No. 15199927.3 (dated Jun. 17, 2016).

* cited by examiner

OSCILLATING SYSTEM FOR A WATCH

CROSS REFERENCE TO RELATED APPLICATIONS

This application is a national phase filing under 35 C.F.R. § 371 of and claims priority to PCT Patent Application No. PCT/EP2016/081005, filed on Dec. 14, 2016, which claims the priority benefit under 35 U.S.C. § 119 of European Patent Application No. 15199927.3, filed on Dec. 14, 2015, the contents of each of which are hereby incorporated in their entireties by reference.

BACKGROUND

Some embodiments relate to a method of adjusting the oscillation frequency of an oscillating system for a watch movement and an oscillating system, as well as a watch movement, according to some other embodiments.

Oscillating systems for mechanical watch movements typically include a balance, the balance typically including a balance rim.

Balances are typically manufactured as follows:

The balance rim is first manufactured as a part turned in a dome. A bore is then provided in the center of the turned part. This is then typically used for centering, for example, to be able to cut out spokes. Naturally, this centering has a certain clearance, which means that the spokes are not perfectly centered, an imbalance being thus generated in the balance. In addition, the dome typically deforms slightly during separation from the stem (which appears typically in the form of a stem of rough material having a diameter of 14 mm and a length of 3 m, for example,) due to the undercut produced by the material stresses which are exerted for different thicknesses. In the end, the fact that the balance rim must or should be made at least in part by turning causes a certain imbalance of the balance due to manufacture.

Alternatively, it is also possible to manufacture the balance assembly by clamping it on a machining center, such as a milling machine. This is mostly a solution for production in limited quantity, and the work cycles on the machine employed are also long in comparison with the method previously exposed, by requiring for example, a span of 15 minutes. Even in this case, deformations generally appear, in this case during separation and/or by material stresses, for example.

Oscillating systems for mechanical watches further typically include a hairspring. The hairsprings that may be required are typically manufactured from a stem, usually drawn. The diameter of an initial material is in this case reduced from some 30 cm to 6 mm approximately, and then brought to the required weight, often at a thickness of only 0.03 to 0.04 mm (with a manufacturing tolerance of a tenth of 1/1000 of a mm) for a height of 0.10 to 0.20 mm, before the characteristic hairspring shape is given after heat treatment and cutting to the required length by a tool rolling several of these strips in a drum.

The hairspring is subjected to thermal stabilization when it is still located in the drum. Very satisfactory homogeneities can be obtained for the manufacturing batch by resorting to modern manufacturing methods, however the distribution of forces vary from one hairspring to another, to which must or should be added that the batches are very different to one another as such, so that too large inequalities exist from one batch to another.

After balancing the balance, this being required due to the abovementioned imbalance due to the conditions of manufacture, the balance is usually placed on a special machine, which measures the mass inertia of the balance after a meticulous adjustment and defines automatically the class to be assigned to the balance.

After the hairspring to be used is cut in the middle, so as to eliminate a hook typically formed by rolling, it is set into place and compressed on a roll, called a hairspring roll. The hairspring is then often slightly de-centered depending on the type of execution, which has a negative impact on the operation of the watch. The hairspring is then placed on a special machine which again compares the distribution of forces of the hairspring to a fixed value to decide the class to be assigned to it.

The hairsprings and the balances of identical classes are then assembled together. The error rate is however generally rather elevated if it is desired to obtain a balance operating with accuracy. To correct, there is indeed an index, but its presence is itself a typical cause of problems, and it effectiveness is also limited. Often it needs to be displaced much too far, and it then influences negatively the isochronism of the watch, in other words the temporally regular oscillation of the balance for different amplitudes. A balance is isochronous if each oscillation is of equal length, independently of amplitude.

It goes without saying that the main desire is that all hairsprings are manufactured with the same class as the assembled balance.

A so-called double roller is then typically clamped complementarily with a cone on the balance. A small ruby is generally clamped in this double roller to reduce the friction and the hardness of the material, the ellipse, which is in principle cylindrical but has a surface on a side. It goes without saying that the installation is not a problem-free operation, no more than the clamping of the double roll.

SUMMARY

The force exerted by the wheelwork of the mechanical watch movement is typically transmitted to the balance by the escapement. The force is in particular typically transmitted by two rubies of the second wheel of the wheelwork, the so-called escapement wheel, to the balance through an ellipse. The escapement is typically manufactured of steel, to obtain the required hardness, and as a result it is relatively heavy. The fixing of the rubies, of the pallets, is also typically problematic, the positioning and especially the isogonality being particularly delicate. In addition, the geometry of the pallets is limited for reasons of manufacture.

Finally, as described in patent EP2 455 825, it may be necessary to have a considerable stock of components in the "Omegametric" system, including classifying hairsprings and balances or in the "Spiromatic" system in which the hairspring is cut to the correct length.

Some embodiments are directed to enhancing the related art devices described above, and in particular to provide a method for adjusting the frequency of an oscillating system. Some embodiments also implement an oscillating system for a mechanical watch movement, of simple construction, of easy and economical manufacture while still ensuring operation of the mechanical watch movement that is as accurate as possible.

Some embodiments rely on or are based on the observation that the presence of a balance rim makes more complex particularly the method of manufacture of the oscillating system, among other reasons because material stresses are formed during the required manufacturing steps, in particular during turning, which generate imbalances in the balance. These imbalances must or should then be compensated in a relatively costly manner. Some embodiments resolve this problem in principle by dispensing with the balance rim, which, although being a component of the watchmaking tradition, makes more delicate the manufacture of oscillating systems.

Thus, a first aspect of some embodiments is a method of adjusting the oscillation frequency of an oscillating system including:

selecting a hairspring, selecting a balance belonging to a predetermined class, without a balance rim, selecting at least two balancing weight elements in a predetermined batch, pairing of the hairspring with the balance and the at least two weight elements, and selecting of at least one of a balance of another class or of the at least two weight elements of another batch if the measured oscillation frequency does not correspond to a desired oscillation frequency.

This oscillation frequency adjustment method for an oscillating system begins by the selection of a hairspring rather than by the selection of a balance, which allow having a method that is more flexible in use, because a hairspring is not easy to modify, while it is much easier to change the balance and/or to select other weight elements. This thus allows overcoming a prejudice of a person of ordinary skill in the art who has the habit of having a considerable stock of components and to begin with the selection of a balance.

Advantageously, the selection will lead to the selection of a non-metallic hairspring, which makes it possible to protect the hairspring from ambient magnetism during operation. The selection of a non-metallic hairspring makes even more advantageous having it selected in the first place due to increased difficulties in modification.

Advantageously, at least one among the two weight elements is an adjusting screw, and the method further includes a step of adjusting the adjustment screw so as to adjust the balancing of the oscillating system, which contributes great flexibility and facilitates the implementation of the oscillation frequency adjustment method, in order to obtain the desire oscillation frequency. In the case where the oscillating system includes only two weight elements, it is advantageous or preferable to select either two identical weight elements or two adjustment screws, so as to preserve the balance of the assembly.

A second aspect of some embodiments is an oscillating system for a watch movement, including:

a balance, the at least two weight elements, and the hairspring, wherein:

the oscillating system does not include a balance rim.

This makes it possible to propose an oscillating system with great ease of implementation and greater accuracy.

In some embodiments, the balance is substantially in the form of a strip or substantially cruciform. The recitations of the terms “bottom plate”, “bottom plate support”, “balance beam” or “balance” is interchangeable herein, but the word balance is recited for reasons of simplicity. Such forms for the balance have the advantage—unlike a conventional balance with a balance rim—of allowing easy manufacture, in particular with methods generating few stresses. A very large number of methods of manufacture are in principle appropriate for the manufacture of the balance, except for turning. The balance is advantageously or preferably manufactured by cutting and/or laser cutting and/or water-jet cutting and/or LIGA machining and/or by additive manufacture or by growth or by a combination of these techniques. In principle, the balance can be produced by any method suitable for machining wafers.

In some embodiments, the balance includes a central portion and at least two first wings. The first wings are typically disposed around the central portion while being spaced at 180°, in other words are exactly opposite on either side of the central portion. The central portion has an axial bore and each of the first wings has a fixing bore for fixing a respective element of the at least two weight elements. In this case, the fixing bores are advantageously provided at the ends of the wings, in other words on the sides of the wings distant from the central portion. Such a balance structure has the advantage of being particularly simple while being effective, because recourse to two weight elements of the same manufacturing batch allows adjustment of the oscillating system to the hairspring used or to its class to be obtained very easily. It is particularly advantageous that each of the two first wings have a longitudinal slot. Such longitudinal slots allow economies of materials to be implemented in a particularly simple manner at the first wings, their weight being reduced in the zone of the longitudinal slots. Such reductions in weight have an advantageous aspect on the operation of the oscillating system, of stabilizing the oscillation behavior. Moreover, the longitudinal slots improve the stiffness in torsion of the bottom plate.

In some embodiments, the oscillating system includes a fixing element for fixing the hairspring on the bottom plate. Recourse to such a fixing element has the advantage of making superfluous a hairspring roll, the structure of the oscillating system and in particular of the shaft being thereby strongly simplified. It also makes superfluous a compression of the hairspring roller, a typical cause of undesirable deformations of the material.

In some embodiments, the fixing element is in the form of a pin, the balance, in particular the central portion, advantageously or preferably including a pin socket for housing the fixing element. This configuration has the advantage of allowing particularly easy manufacture and assembly. The pin is advantageously or preferably brazed to the hairspring and fitted into the pin socket. The pin socket is advantageously or preferably through and advantageously or preferably implemented as a bore. The pin socket can also be simply replaced by an opening in the balance, arranged to receive the pin.

In some embodiments, the oscillating system includes a lever element. Such a lever element has the advantage of allowing particularly easy connection to the escapement of the mechanical watch movement. An alternative to the lever element can be a corresponding configuration of the escapement and/or a double roller.

In some embodiments, the lever element is made as an impulse pin, particularly as a lever ellipse, and very advantageously as a partial lever ellipse cylinder, in particular the central portion, advantageously or preferably including a lever socket for housing the lever element or more simply an opening arranged to receive the lever. The impulse pin is advantageously or preferably fitted by compression into the lever socket. The lever socket is advantageously or preferably made through, in other words it passes through the bottom plate over its entire thickness. Such an arrangement of the impulse pin and of the lever socket has the advantage of ensuring horizontality between the lever element and the escapement in a particularly simple manner. Alternatively, it will also be possible to use a lever element configured differently and/or to dispose otherwise the lever element, in this case as a portion of the shaft or of a double roller for example.

In some embodiments, the shaft includes a single roller, which is advantageously or preferably provided to operate as an integrated safety roller and/or to limit a movement of a safety strip. Such a configuration of the shaft has the advantage of simplifying considerably the construction of the oscillation system with respect to a conventional balance, because no double roller is required.

In some embodiments, the shaft has a first segment, a second segment, a third segment and two bearing segments, each of the bearing segments advantageously or preferably having a first partial bearing segment and a second partial bearing segment. Such a configuration of the shaft is particularly advantageous, because it facilitates manufacture and minimizes manufacturing tolerances. In particular, the height clearance thus has less impact on the manufacturing tolerances, because the elimination of the double roller means that only one dimension has to be respected. The elimination of the double roller also minimizes the risk of deformation of the material.

In some embodiments, the single roller has a recess, particularly a lateral recess, formed so as to function as an integrated safety roller and/or to limit the movement of a safety strip of the mechanical watch movement. This recess is advantageously or preferably made in the form of an elliptic arc. The presence of such a simple roller is advantageous because it simplifies the construction of the oscillating system.

In some embodiments, the hairspring has a concentric portion and an Archimedes screw portion, the concentric portion being included at least partially inside the Archimedes screw portion. This is advantageous in that satisfactory centering of the hairspring is thus obtained in a simple manner, which contributes to minimizing errors in balancing.

In some embodiments, the balance includes at least two second wings. The second wings are advantageously or preferably disposed alternately to the first wings around the central portion, in particular with angular spacings of 90°, so as to form a substantially cruciform balance. The presence of two second wings in addition to the two first wings has the advantage of allowing the possibility of additional adjustment for the oscillating system. This is advantageous in particular if no index is provided in the oscillating system.

In some embodiments, each of the second wings includes an angled element, each angled element advantageously or preferably having an angled bore for housing an adjusting screw. This has the advantage of simply allowing additional adjustment possibilities for the oscillating system. It is particularly advantageous that two angled bores are provided in each angled element, so that two adjusting screws can be tightened in each angled element, in particular a large adjusting screw and a small adjusting screw. The presence of two adjusting screws has the advantage of allowing the compensation of more considerable class differences than if a single adjusting screw was present per angled element. The use of standard hairsprings of relatively simple construction would thus also be made possible, and/or the manufacturing tolerances could be less constraining for the hairspring used. Advantageously, the angled element can be carried out by bending or using a bracket, which allows easy implementation at a controlled cost.

In some embodiments, each angled element has a slot provided for cooperating with the angled bore to allow secure tightening of the adjusting screw in the angled bore. Each angled element advantageously includes two adjusting screws, two angled bores and two slots. It is particularly advantageous that one of the adjusting screws of each angled element is longer than the other, the large adjusting screw being advantageously implemented as a weight screw and the small adjusting screw being advantageously implemented as an adjusting screw. It is particularly advantageous that the large adjusting screw is at least partially made of gold and/or that the small adjusting screw is at least partially made of copper or copper alloy, particularly CuBe.

Advantageously, the angled element has an angle of 90°. This allows an oscillating system to be proposed with greater facility of implementation and a simplified design.

Advantageously, which angled element has an angle of 45°, which allows an improvement in the accessibility of the adjusting screw during balancing of the assembly, particularly if re-adjustment may be necessary.

Advantageously, the hairspring is non-metallic, which allows magnetism to be neglected on a part sensitive to its effects.

A watch movement according to some embodiments includes an oscillating system according to some embodiments. It is advantageous that an escapement of the watch movement and/or an escapement wheel of the watch movement are made of ruby. This has a positive impact on the mass of the mechanical watch movement and the friction conditions that occur in it.

BRIEF DESCRIPTION OF THE FIGURES

Some embodiments will be described in detail hereafter with reference to the figures, these representing.

DETAILED DESCRIPTION OF EXEMPLARY EMBODIMENTS

Figure 1:
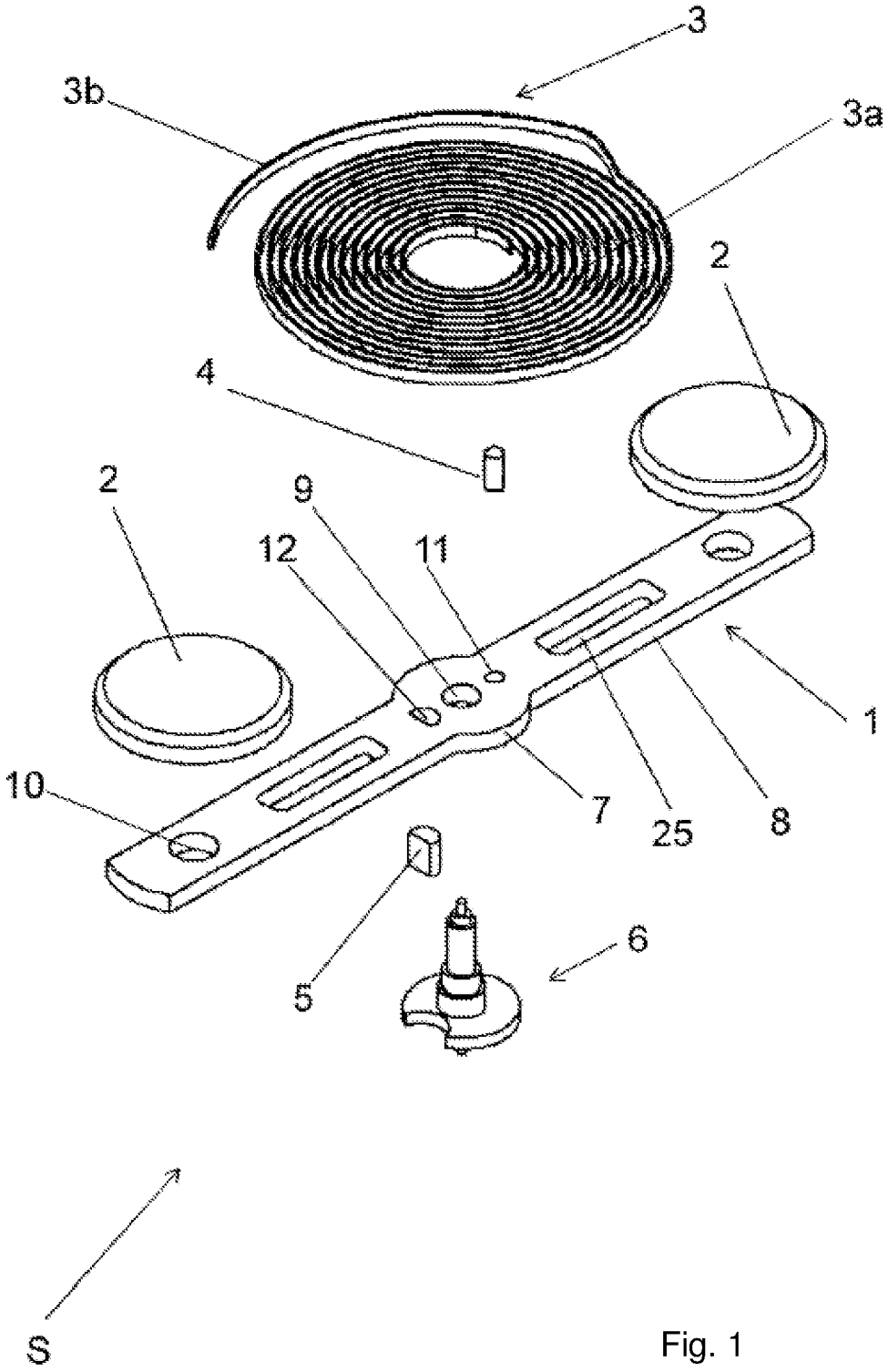
FIG. 1: a first exemplary embodiment of an oscillation system according to some embodiments, in an exploded view.

FIG. 1 illustrates a first exemplary embodiment of an oscillating system S according to some embodiments for mechanical watch movement in an exploded view. The balance 1 shown in FIG. 1 has a central portion 7 and two first wings 8 (for better legibility, only one of the two first wings 8, in this case the wing on the observer's right, is provided with a reference symbol in FIG. 1). The balance 1 has substantially the shape of a strip, slight rounded portions being shown only in the region of the central portion 7 and of the respective ends of the two first wings 8, the rounded portions preventing at least partially the formation of burrs.

The balance 1 includes, in the region of its central portion 7, a shaft bore 9 which is located in the geometric center of the balance 1, as well as a pin socket 11 and a lever socket 12. Each of the two first wings 8 of the balance 1 further includes a fixing bore 10 (for better legibility, only one of the two fixing bores 10, in this case the bore to the observer's left, is provided with a reference symbol in FIG. 1) and a longitudinal slot 25 (a reference symbol again being provided for only one of the two slots).

The oscillating system S further includes a shaft 6, to which the balance 1 can be fixed, in particular placed and/or press-fitted.

The oscillating system S further includes a hairspring 3. The hairspring 3 has a concentric inner portion 3*a*, which extends concentrically around the shaft 6 when the oscillating system S is assembled, and an Archimedes screw portion 3*b*. During manufacture of the oscillating system S, a fixing element 4, in particular a pin, is applied inside the hairspring 3, in particular by being brazed. This fixing element 4 is itself press-fitted in the pin socket 11, which accomplishes the connection of the hairspring 3 to the bottom plate 1. The hairspring 3 can also be fixed to the balance 1 through a collet connected to the shaft 6. The fixing element 4 can also be a screw.

The oscillating system S further includes two weight elements 2. Each of these weight elements 2 can be fitted in a respective bore of the two fixing bores 10 to connect the weight elements 2 to the balance 1. To this end, each weight element 2 includes a fixing shaft 26. The fixing shafts are not visible, however, in FIG. 1, because they are disposed on the bottom of the weight elements 2. Weight elements 2 of different sizes and weights can be used to optimally adapt each oscillating system S to the spring effect of the hairspring 3 carried out.

Figure 2:
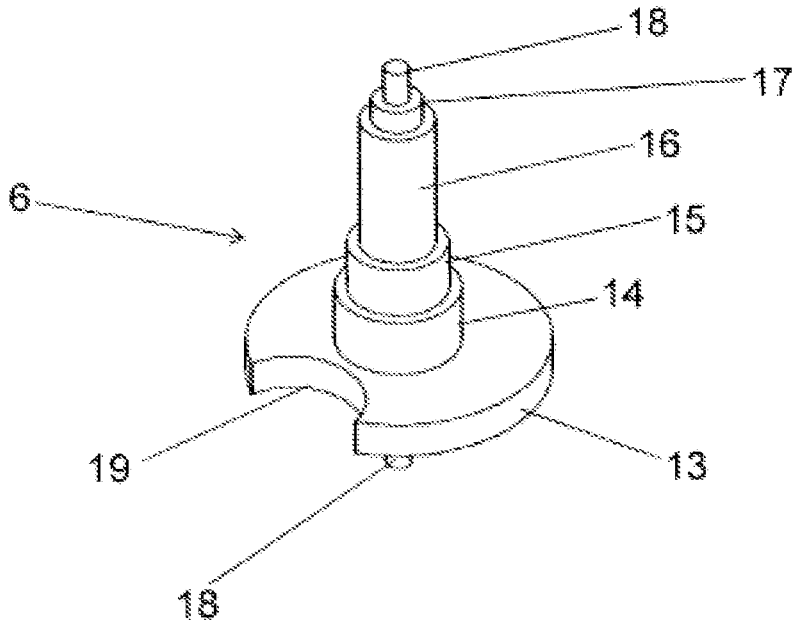
FIG. 2: a perspective view of a shaft according to some embodiments.

FIG. 2 shows a perspective view of a shaft 6 according to some embodiments. The shaft 6 includes a single roller 13, a first segment 14, a second segment 15 and a third segment 16. The first segment 14 is contiguous with the single roller 13 and all the segments, it is the one having the greatest diameter. The diameter of the second segment 15 is less than that of the first segment 14 but greater than that of the third segment 16, which is contiguous with the second segment 15. The first segment 14 and the second segment 15 have a substantially equal length, and the third segment 16 is substantially twice as long as the first segment 14 and/or the second segment 15.

"Length" refers in this case to the axial direction of the shaft 6. The shaft 6 further has a bearing segment at its two ends. Each of the two bearing segments includes a first partial bearing segment 17 and a second partial bearing segment 18. Of the bearing portion situated below the single roller 13, only the second partial bearing segment 18 is visible to the observer. The second partial bearing segment 18 is longer than the first partial bearing segment 17 but has a smaller diameter than the latter. In the assembled state of the oscillating system S, the shaft 6 passes into the shaft bore 9, the balance 1 resting on the first segment 14, the second segment 15 being located at least in part in the shaft bore 9, and the third segment 16 extending beyond the bottom plate 1 (see FIG. 4). It also appears in FIG. 2 that the single roller 13 has a recess 19 which allows the single roller 13 to operate as an integrated safety roller and/or to limit the movement of a safety strip of the mechanical watch movement. The roller 13 can also act as a support for the balance 1.

Figure 3:
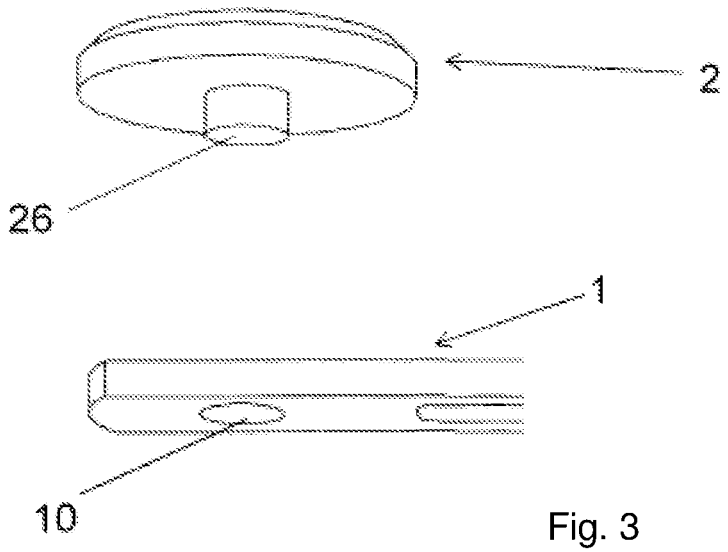
FIG. 3: a perspective view of a weight element according to some embodiments and its fixing to a balance according to some embodiments.

FIG. 3 shows a perspective view of a weight element 2 according to some embodiments and its fixing to a bottom plate 1 according to some embodiments. What is visible is only the fixing shaft 26 on the underside of the weight element 2, which is provided to engage in the fixing bore 10 of the bottom plate 1 shown fragmentarily in FIG. 3.

Figure 4:
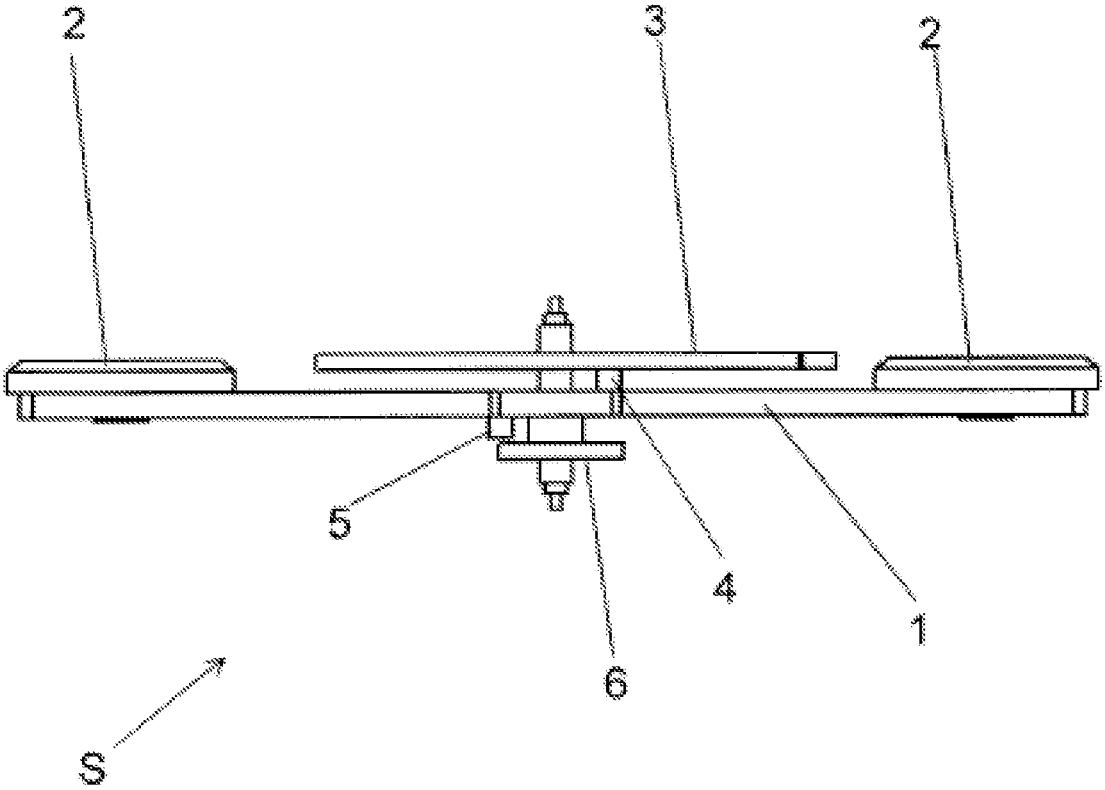
FIG. 4: a side view of the first exemplary embodiment of an oscillating system according to some embodiments in the final assembly state.

FIG. 4 shows a lateral view of the first exemplary embodiment of an oscillating system S according to some embodiments in the final assembly state. For better legibility, not all the components are provided with a reference symbol in FIG. 4. The two weight elements 2 are press-fitted into the bottom plate 1. The shaft 6 passes through the balance 1 at its center (as previously described for FIG. 2). The lever element 5 is press-fitted into the balance 1 from below. The fixing element 4 is press-fitted into the balance 1 from above. The hairspring 3 is fixed to the fixing element 4.

As previously described in part, the pre-assembled oscillating system S has several advantages. On the one hand, it is possible to stamp the balance 1 in a single pass or cut it out in a single clamping. It is thus possible to manufacture a balance 1 with absolute balancing, because the shaft bore 9 for the shaft 6 is simultaneously created, as well as the socket for housing the lever element 5.

In addition, the weight elements 2 which are assembled afterward to increase the mass inertia and typically manufactured in different sizes, can be used to adjust in a particularly simple manner the oscillating system S to the distribution of forces of the manufacturing batch of the hairspring 3. Moreover, the elimination of the balance wheel makes the oscillating system S substantially less affected by imbalances or problems of concentricity and horizontality than a conventional balance.

Another advantage is that a portion of the usual double roller is practically directly assembled to the shaft 6, and as the other portion of the double roller disappears due to the direct press fitting of the lever element 5 in the balance 1, a double roller is no longer required as a component. The hairspring roller typically used on a conventional balance also disappears, because the hairspring 3 is directly fixed to the fixing element 4, which itself is fitted into the balance 1. The shaft 6 of the oscillating system S is thereby strongly simplified overall with respect to a conventional balance. The elimination of the hairspring roller also makes superfluous the riveting of the shaft 6, as is typically the case on a typical balance, this being able to be easily press-fitted in the balance 1.

Finally, another advantage result in that the function of the ellipse is henceforth directly integrated into the shaft 6. In order for the friction conditions to again be compliant, the escapement is then made of ruby. It is also advantageous that the escapement wheel be made of ruby, in particular if a direct impulse click, in other words without an escapement, is used. In this case, the escapement wheel directly drives the oscillating system, i.e. without an escapement. Another advantage of creating these components of ruby is that they are lighter, which reduces their mass inertia.

Figure 5:
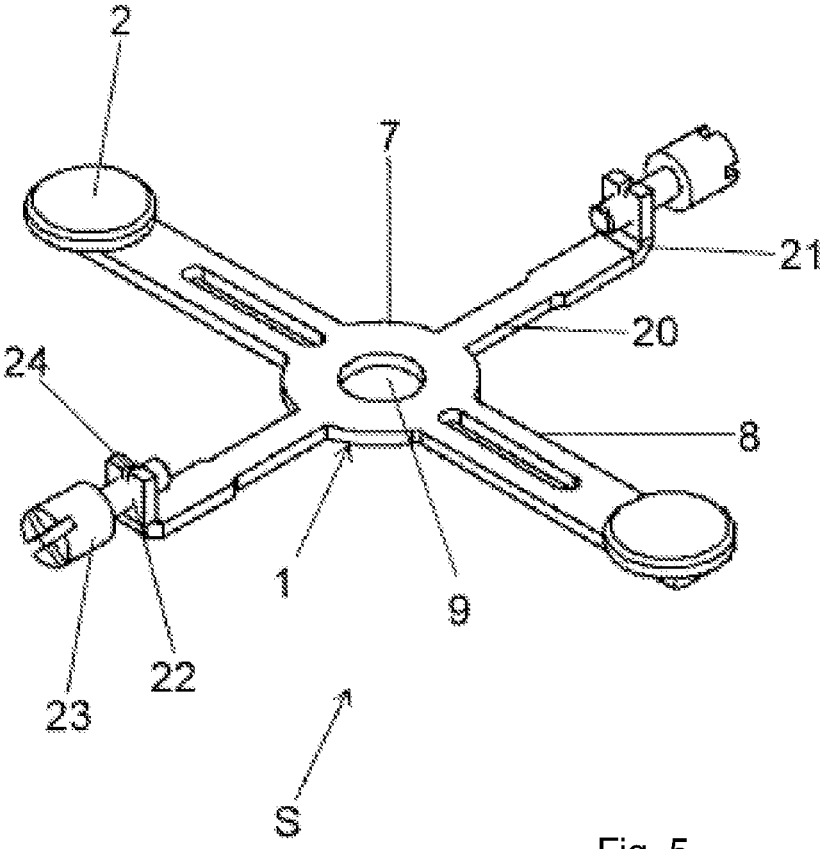
FIG. 5: a second exemplary embodiment of an oscillation system according to some embodiments in a perspective view.

FIG. 5 shows a portion of a second exemplary embodiment of an oscillation system S according to some embodiments, in a perspective view. The oscillating system S of FIG. 5 is shown without a shaft and without a hairspring. It can in principle be combined with the shaft 6 shown in the preceding figures and the hairspring 3 also shown in the preceding figures. The oscillating system S includes a substantially cruciform balance 1. The balance 1 has a central portion 7 with a shaft bore 9 where the shaft 6 passes once the oscillating system S is assembled. Two first wings 8 (only one being provided with a reference symbol in FIG. 5) extend toward the exterior from the central portion 7, at each of the extremities of which a weight element 2 is mounted (only one being provided with a reference symbol in FIG. 5). The first wings 8 are disposed exactly in opposition with respect to the central portion 7. Two second wings 20 are also exactly opposed with respect to the central portion. An angle of 90° is formed between a second wing 20 and a first wing 8. In other words, the first wings 8 and the second wings 20 are disposed in a regularly alternate manner around the central portion 7. Each second wing 20 has at its end an angled element 21. Each angled element 21 includes an angled bore 22 where an adjusting screw 23 can be tightened, in such a manner that a central axis of the adjusting screw 23 extends perpendicularly to an axis of rotation of the oscillating system S passing through the shaft. The adjusting screws 23 serve for precise adjusting of the oscillating system S. Moreover, each angled element 21 has a slot 24 capable of cooperating with the angled bore 22, so as to allow secure screwing of the adjusting screw 23 in the angled bore 22.

Figure 6:
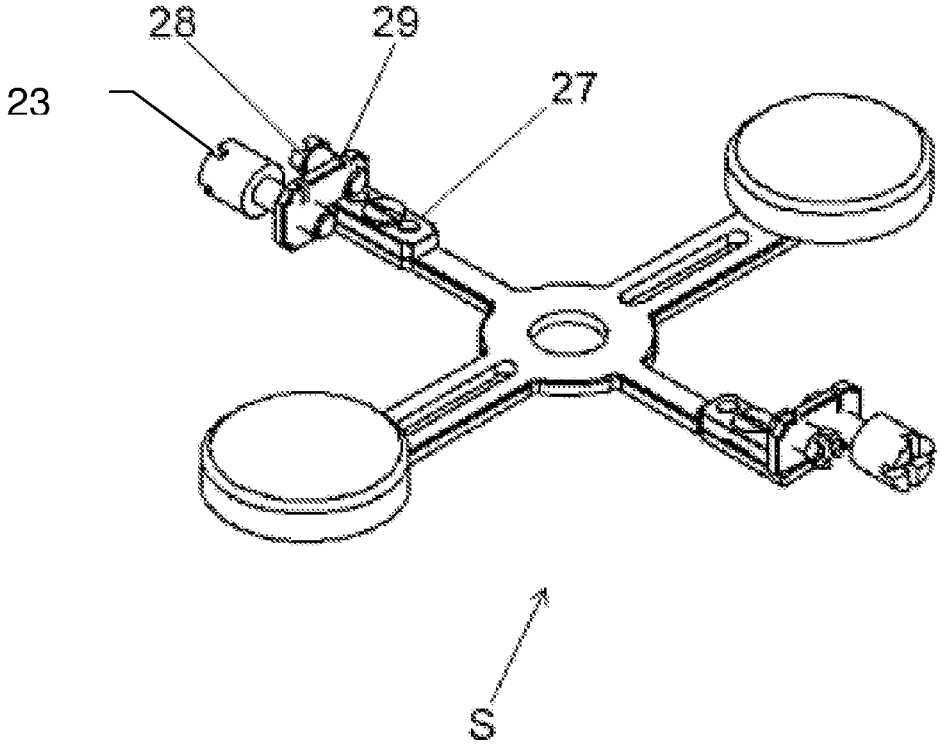
FIG. 6: a third exemplary embodiment of an oscillating system according to some embodiments, in a perspective view.

FIG. 6 shows a portion of a third exemplary embodiment of an oscillating system S according to some embodiments in a perspective view. The third exemplary embodiment corresponds substantially to the second exemplary embodiment, the angled elements of the third exemplary embodiment being screwed to the second wings in the form of bracket parts 27, implemented by bending to 90° the ends of the second wings 20, unlike the second exemplary embodiment. In addition, each bracket part 27 of the third exemplary embodiment includes a second adjusting screw 28 in addition to the adjusting screw 23 already present in the second exemplary embodiment, which is associated with a corresponding second slot 29. Only the components shown there for the first time are provided with a reference symbol in FIG. 6.

The cruciform exemplary embodiments illustrated by FIGS. 5 and 6 can generally be combined with all the features of the first exemplary embodiment, for example, with the fixing element 4 and the lever element 5.

Other exemplary embodiments of some embodiments are illustrated in FIGS. 7 to 10, so as to propose oscillating systems with different combinations of components described above (numbering is streamlined for the purpose of clarity and of explanation of the different combinations).

Figure 7:
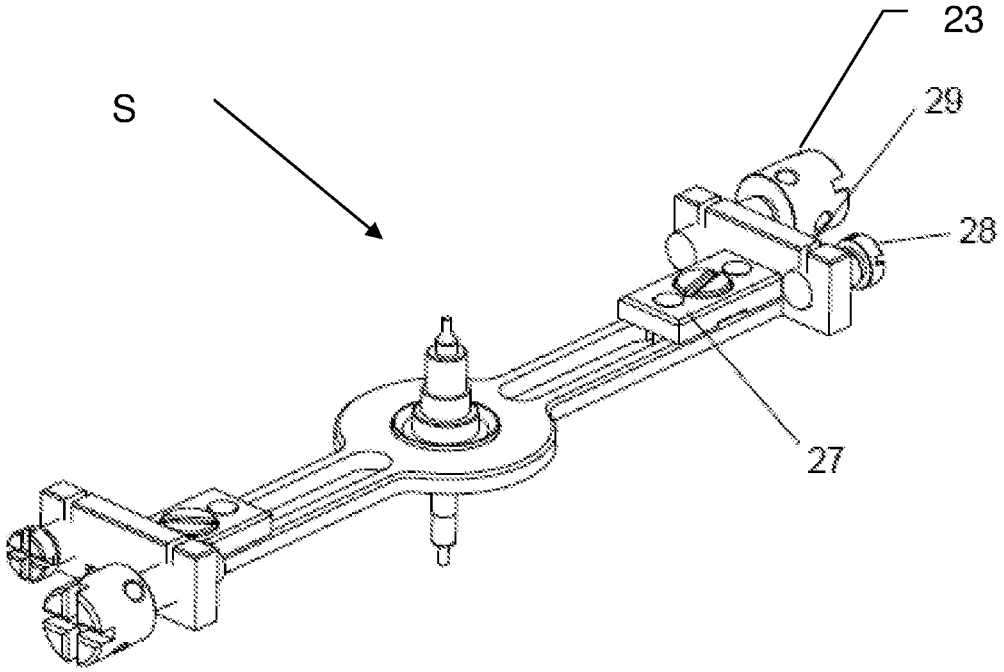
FIG. 7: a fourth exemplary embodiment of an oscillating system according to some embodiments, in a perspective view.

FIG. 7 shows a fourth exemplary embodiment of an oscillating system S with two bracket parts 27, each including a second adjusting screw 28 in addition to the adjusting screw 23 already present in the third exemplary embodiment, which is associated with a corresponding slot 29, replacing the weight elements 2 that are visible in FIG. 1.

Figure 8:
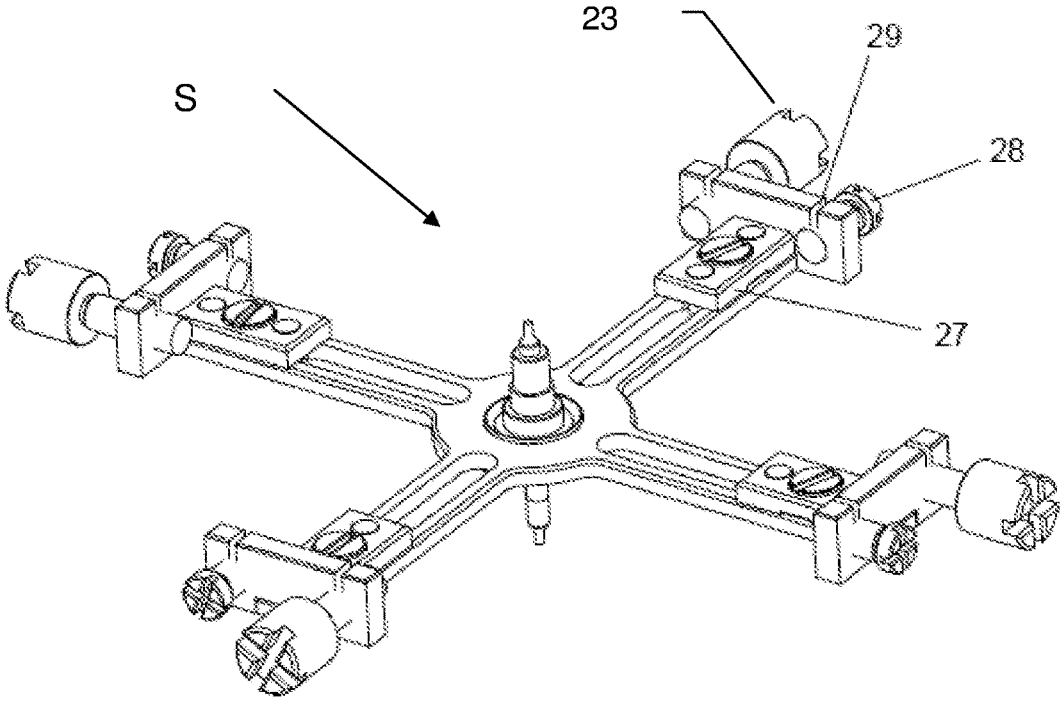
FIG. 8: a fifth exemplary embodiment of an oscillating system according to some embodiments in a perspective view.

FIG. 8 shows a fifth exemplary embodiment of an oscillating system S with four bracket parts 27, each including a second adjusting screw 28 in addition to the adjusting screw 23 as shown in the third exemplary embodiment, which is associated with a corresponding slot 29, replacing the weight elements 2 that are visible in FIG. 1. This has the advantage of being more easily adjustable than the third example.

Figure 9:
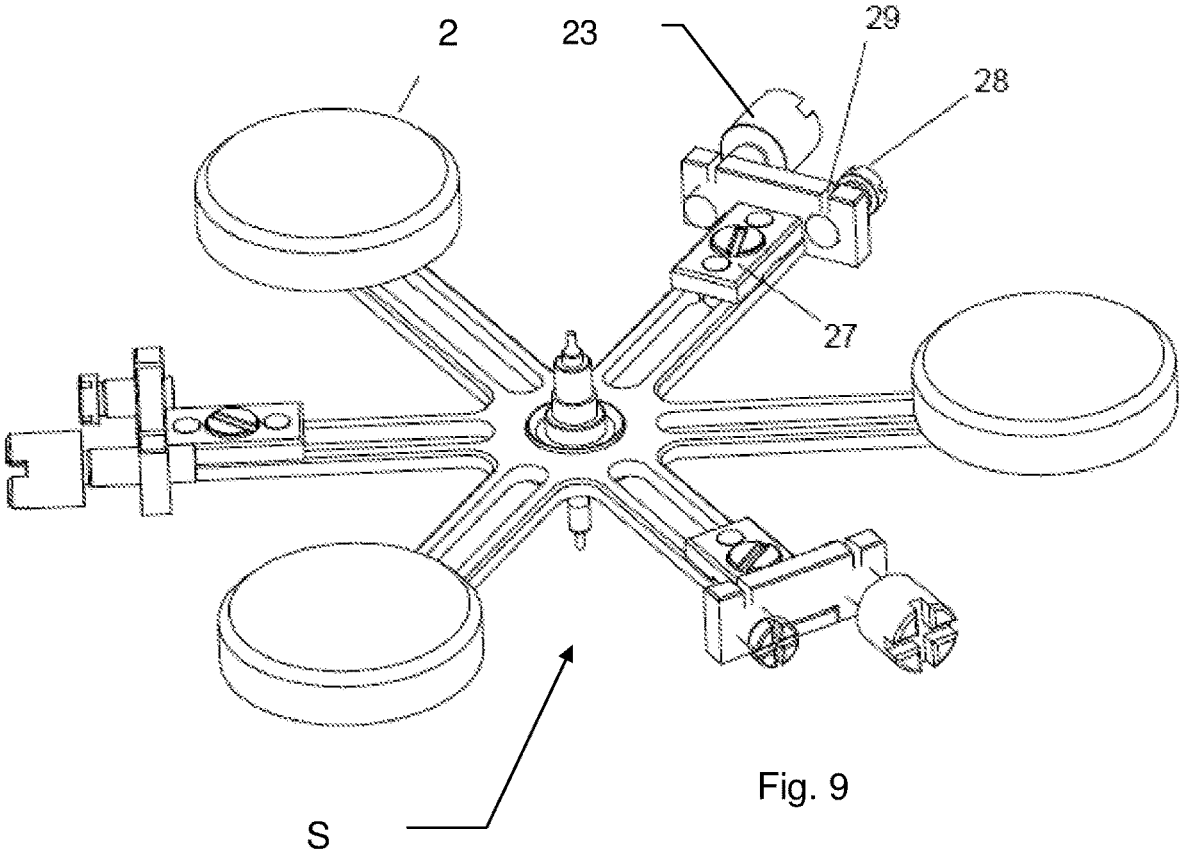
FIG. 9: a sixth exemplary embodiment of an oscillating system according to some embodiments in a perspective view.

FIG. 9 shows a sixth example of an oscillating system S with three weight elements 2 and three bracket parts 27, each including a second adjusting screw 28 in addition to the adjusting screw 23 already present in the third exemplary embodiment, which is associated with a corresponding slot 29. The advantage here is to have more adjustment methods, with different angles.

Figure 10:
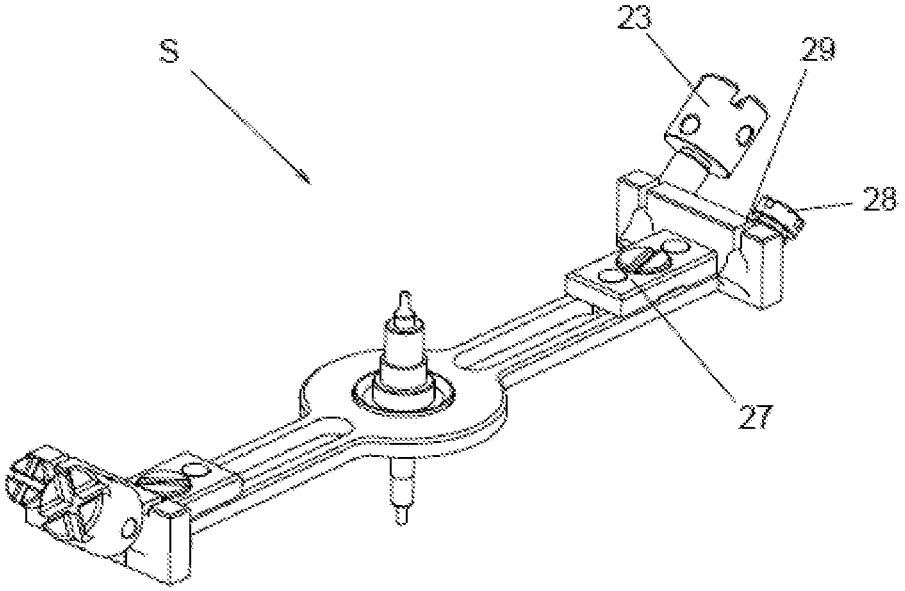
FIG. 10: a seventh exemplary embodiment of an oscillating system according to some embodiments in a perspective view.

FIG. 10 shows a seventh example of an oscillating system S with two bracket parts 27, each including a second adjusting screw 28 in addition to the adjusting screw 23 already present in the third exemplary embodiment, which is associated with a corresponding slot 29, replacing the mass elements 2 that are visible in FIG. 1. The adjusting screws 23 and 28 are inclined at 45° so as to improve accessibility when the oscillating system S is nested.

The invention claimed is:

1. An oscillating system for a watch movement, comprising:

a balance, at least two weight elements, and a hairspring, wherein the oscillating system does not include a balance rim and wherein the balance is substantially in the form of a strip or substantially cruciform, in that the balance includes a central portion and at least two first wings, and the central portion having a shaft bore and each of the first wings having a fixing bore for fixing a respective one of the at least two weight elements, the balance extending along a central axis of the balance, and the shaft bore and both the fixing bores, of the first wings, being positioned on the central axis, such that the shaft bore and both the fixing bores are aligned along the central axis; and each of the weight elements including a fixing shaft that extends into a respective fixing bore so as to attach the weight elements onto the balance, such that the weight elements are also positioned on the central axis; and the oscillating system includes a fixing element for fixing the hairspring on the balance;

wherein the oscillating system further includes a shaft, wherein the shaft includes a single roller; and the single roller is provided to operate as an integrated safety roller and/or to limit a movement of a safety strip;

wherein the single roller has a recess;

wherein the balance includes at least two second wings;

wherein each of the second wings includes an angled element carried out by bending or using a bracket, each angled element having an angled bore for housing an adjusting screw, each angled element having a slot provided for cooperating with the angled bore to allow secure tightening of the adjusting screw in the angled bore; and wherein the angled element has an angle of 45° relative to a plane in which the balance is disposed.

2. The oscillating system according to claim 1, wherein the fixing element is in the form of a pin, and the central portion of the balance including a pin socket for housing the fixing element.

3. The oscillating system according to claim 1, wherein the hairspring is non-metallic.

4. A watch movement, comprising:

the oscillating system according to claim 1.

5. The watch movement according to claim 4, wherein an escapement of the watch movement and/or an escapement wheel of the watch movement are fixed in a ruby.

6. An oscillating system for a watch movement, comprising:

a balance, at least two weight elements, and a hairspring, wherein the oscillating system does not include a balance rim and wherein the balance is substantially in the form of a strip or substantially cruciform, in that the balance includes a central portion and at least two first wings, and the central portion having a shaft bore and each of the first wings having a fixing bore for fixing a respective one of the at least two weight elements, the balance extending along a central axis of the balance, and the shaft bore and both the fixing bores, of the first wings, being positioned on the central axis, such that the shaft bore and both the fixing bores are aligned along the central axis; and each of the weight elements including a fixing shaft that extends into a respective fixing bore so as to attach the weight elements onto the balance, such that the weight elements are also positioned on the central axis; and the oscillating system includes a fixing element for fixing the hairspring on the balance;

each of the second wings includes an angled element carried out by bending or using a bracket, each angled element having an angled bore for housing an adjusting screw, each angled element having a slot provided for cooperating with the angled bore to allow secure tightening of the adjusting screw in the angled bore; and wherein the angled element has an angle of 45° relative to a plane in which the balance is disposed.

7. An oscillating system for a watch movement, comprising:

a balance, at least two weight elements, and a hairspring, wherein the oscillating system does not include a balance rim and wherein the balance is substantially in the form of a strip or substantially cruciform, in that the balance includes a central portion and at least two first wings, and the central portion having a shaft bore and each of the first wings having a fixing bore for fixing a respective one of the at least two weight elements, and the oscillating system includes a fixing element for fixing the hairspring on the balance;

wherein the balance includes at least two second wings, wherein each of the second wings includes an angled element carried out by bending or using a bracket, each angled element having an angled bore for housing an adjusting screw, each angled element having a slot provided for cooperating with the angled bore to allow secure tightening of the adjusting screw in the angled bore; and wherein the angled element has an angle of 45° relative to a plane in which the balance is disposed.

* * * * *